US011015282B2

(12) United States Patent
Feng

(10) Patent No.: US 11,015,282 B2
(45) Date of Patent: May 25, 2021

(54) CLOTHES DRYER, METHOD AND DEVICE FOR CALCULATING HUMIDITY VALUE OF CLOTHES IN CLOTHES DRYER

(71) Applicant: WUXI FILIN ELECTRONICS CO., LTD., Wuxi (CN)

(72) Inventor: Jinglin Feng, Wuxi (CN)

(73) Assignee: WUXI FILIN ELECTRONICS CO., LTD., Wuxi (CN)

( * ) Notice: Subject to any disclaimer, the term of this patent is extended or adjusted under 35 U.S.C. 154(b) by 86 days.

(21) Appl. No.: 16/372,244

(22) Filed: Apr. 1, 2019

(65) Prior Publication Data

US 2019/0226140 A1 Jul. 25, 2019

Related U.S. Application Data

(63) Continuation of application No. PCT/CN2017/095058, filed on Jul. 28, 2017.

(30) Foreign Application Priority Data

Sep. 30, 2016 (CN) ..... 201610874627.9

(51) Int. Cl.
*D06F 58/30* (2020.01)
*D06F 58/38* (2020.01)

(52) U.S. Cl.
CPC ..... *D06F 58/30* (2020.02); *D06F 58/38* (2020.02)

(58) Field of Classification Search
CPC ..... D06F 58/30; D06F 58/38; D06F 2103/08; D06F 2103/38; D06F 2105/58; D06F 34/28; D06F 58/50; F26B 25/22; F26B 17/006; F26B 17/007; F26B 21/083; F26B 2210/16; F26B 25/003; F26B 5/16; F26B 21/06; F26B 3/286; F26B 9/063
See application file for complete search history.

(56) References Cited

U.S. PATENT DOCUMENTS

2013/0091728 A1 4/2013 Morin et al.

FOREIGN PATENT DOCUMENTS

| | | | |
|---|---|---|---|
| CN | 1696390 | A | 11/2005 |
| CN | 101177910 | A | 5/2008 |
| CN | 102656315 | A | 9/2012 |
| CN | 103502525 | A | 1/2014 |
| CN | 105105694 | A | 12/2015 |
| CN | 105509246 | A | 4/2016 |

(Continued)

OTHER PUBLICATIONS

Wuxi Filin Electronics Co. Ltd., Extended European Search Report, EP17854557.0, dated Sep. 5, 2019, 10 pgs.

(Continued)

*Primary Examiner* — Jason Lau
(74) *Attorney, Agent, or Firm* — Morgan, Lewis & Bockius LLP

(57) ABSTRACT

A clothes dryer (100), a method and device (200) for calculating a humidity value of clothes in the clothes dryer. The method for calculating the humidity value includes: acquiring sampling points of a humidity sensor during a first time period; extracting a maximum value from the sampling points, and generating a maximum-value accumulated value; acquiring maximum-value accumulated values during a second time period, and generating an average value; acquiring a current maximum value during a current first time period; and generating a current humidity value.

13 Claims, 4 Drawing Sheets

(56) References Cited

FOREIGN PATENT DOCUMENTS

| | | | |
|---|---|---|---|
| CN | 105648728 | A | 6/2016 |
| CN | 106337271 | A | 1/2017 |
| EP | 0226209 | A2 | 6/1987 |
| EP | 0388939 | A1 | 9/1990 |
| EP | 2407590 | A1 | 1/2012 |
| JP | 2006296993 | A | 11/2006 |
| KR | 20050018036 | A | 2/2005 |
| KR | 20140125899 | | 10/2014 |
| WO | WO02/090855 | A1 | 11/2002 |

OTHER PUBLICATIONS

Wuxi Filin Electronics Co. Ltd., International Search Report and Written Opinion, PCT/CN2017/095058, dated Mar. 22, 2018, 18 pgs.

Wuxi Filin Electronics Co. Ltd., First Office Action, CN201610874627.9, dated Feb. 24, 2018, 8 pgs.

CLOTHES DRYER, METHOD AND DEVICE FOR CALCULATING HUMIDITY VALUE OF CLOTHES IN CLOTHES DRYER

CROSS REFERENCE TO RELATED APPLICATIONS

This application is a continuation of PCT/CN2017/095058, filed on Jul. 28, 2017, which claims priority to Chinese Patent Application No. 201610874627.9, filed on Sep. 30, 2016, all of which are hereby incorporated by reference in their entirety.

FIELD

The present disclosure relates to a technical field of household appliances, particularly, to a method for calculating a humidity value of clothes in a clothes dryer, to a device for calculating a humidity value of clothes in a clothes dryer, and to a clothes dryer as such.

BACKGROUND

With the improvement in life, people have higher and higher requirement for electronic appliances. A clothes dryer provides a clothes drying method in humid weather, serious air pollution and poor sunlight, or the like, is becoming more and more popular. At present, the clothes dryer on the market detects humidity of clothes mainly by means of an air-temperature graph or a humidity sensor, thereby judging a degree of dryness of the clothes. However, the problem is that the drying effect is unstable, which is represented mainly in two aspects: first, the humidity after drying by the clothes dryer is unstable, or the clothes is too dry, which damages the clothes; second, the machine ends operation before the drying is completed failing to achieve the drying purpose.

SUMMARY

The present disclosure seeks to solve at least one of the problems existing in the related art to at least some extent. To this end, a first purpose of the present disclosure is to provide a method for calculating a humidity value of clothes in a clothes dryer, to ensure accuracy of humidity calculation and a desired drying effect of the clothes.

A second purpose of the present disclosure is to provide a device for calculating a humidity value of clothes in a clothes dryer, and a third purpose of the present disclosure is to provide a clothes dryer as such.

In order to achieve the above purposes, embodiments of a first aspect of the present disclosure provide a method for calculating a humidity value of clothes in the clothes dryer. The method includes:

acquiring a plurality of sampling points of a humidity sensor during a first time period;

extracting a maximum value from the plurality of sampling points, and generating a maximum-value accumulated value according to the maximum value during the first time period;

acquiring a plurality of maximum-value accumulated values during a second time period, and generating an average value during the second time period, the second time period including a plurality of first time periods;

acquiring a plurality of current sampling points during a current first time period, and acquiring a current maximum value of the current sampling points; and generating a current humidity value according to the current maximum value and the average value.

In the method for calculating the humidity value of clothes in the clothes dryer, first, the plurality of sampling points of the humidity sensor during the first time period are acquired. Next, the maximum value is extracted from the plurality of sampling points, and the maximum-value accumulated value is generated according to the maximum value during the first time period. Then the plurality of maximum-value accumulated values during the second time period are acquired, and the average value during the second time period is generated, in which the second time period includes a plurality of first time periods. Next, the plurality of current sampling points during the current first time period are acquired, and the current maximum value of the current sampling points is acquired. Finally the current humidity value is generated according to the current maximum value and the average value. Therefore, the humidity situation of the clothes in the clothes dryer can be comprehensively considered with the method for calculating the humidity value of clothes in the clothes dryer, which prevents from excessive drying or incomplete drying of the clothes, and improves the user experience.

Additionally, the method for calculating the humidity value of the clothes in the clothes dryer according to the above embodiments of the present disclosure may further have the following additional technical features.

According to an embodiment of the present disclosure, the average value during the second time period is generated by the following formula:

$$(\Sigma(\text{maxNewHumiValue1sec}*\text{the first time period}))/(\text{the second time period}*60),$$

in which the maxNewHumiValue1sec represents the maximum-value accumulated value.

According to an embodiment of the present disclosure, the first time period is 0.5-1.5 seconds.

According to an embodiment of the present disclosure, the second time period is 2-4 minutes.

According to an embodiment of the present disclosure, the current humidity value is generated by the following formula:

$$\text{the current humidity value}=\text{the average value}*0.995+\text{the current maximum value}*0.005.$$

In order to achieve the above purposes, embodiments of a second aspect of the present disclosure provide a device for calculating a humidity value of clothes in the clothes dryer. The device includes:

a first acquisition module configured to acquire a plurality of sampling points of a humidity sensor during a first time period;

a first generation module configured to extract a maximum value from the plurality of sampling points, and generate a maximum-value accumulated value according to the maximum value during a first time period;

a second generation module configured to acquire a plurality of maximum-value accumulated values during a second time period, and generate an average value during the second time period, the second time period including a plurality of first time periods;

a second acquisition module configured to acquire a plurality of current sampling points during a current first time period, and acquire a current maximum value of the current sampling points; and a third generation module configured to generate a current humidity value according to the current maximum value and the average value.

In the device for calculating the humidity value of clothes in the clothes dryer, the plurality of sampling points of the humidity sensor during the first time period are acquired by means of the first acquisition module. Next, the first generation module extracts the maximum value from the plurality of sampling points, and generates the maximum-value accumulated value according to the maximum value during the first time period. Then the second generation module acquires the plurality of maximum-value accumulated values during the second time period, and generates the average value during the second time period, in which the second time period includes a plurality of first time periods. Next, the second acquisition module acquires the plurality of current sampling points during the current first time period, and acquires the current maximum value of the current sampling points. Finally, the third generation module generates the current humidity value according to the current maximum value and the average value. Therefore, the humidity situation of the clothes in the clothes dryer can be comprehensively considered, which prevents from excessive drying or incomplete drying of the clothes, and improves the user experience.

Additionally, the device for calculating the humidity value of the clothes in the clothes dryer according to embodiments of the present disclosure may further have the following additional technical features.

According to an embodiment of the present disclosure, the average value during the second time period is generated by the following formula:

$$(\Sigma(\text{maxNewHumiValue1sec}*\text{the first time period}))/(\text{the second time period}*60),$$

in which the maxNewHumiValue1sec represents the maximum-value accumulated value.

According to an embodiment of the present disclosure, the first time period is 0.5-1.5 seconds, and the second time period is 2-4 minutes.

According to an embodiment of the present disclosure, the current humidity value is generated by the following formula:

$$\text{the current humidity value}=\text{the average value}*0.995+\text{the current maximum value}*0.005.$$

In order to achieve the above purposes, embodiments of a third aspect of the present disclosure provide a clothes dryer including the above-described device for calculating the humidity of the clothes.

In the clothes dryer according to embodiments of the present disclosure, by providing the device for calculating the humidity of the clothes, the humidity situation of the clothes in the clothes dryer can be comprehensively considered, which prevents from excessive drying or incomplete drying of the clothes, and improves the user experience.

Figure 1:
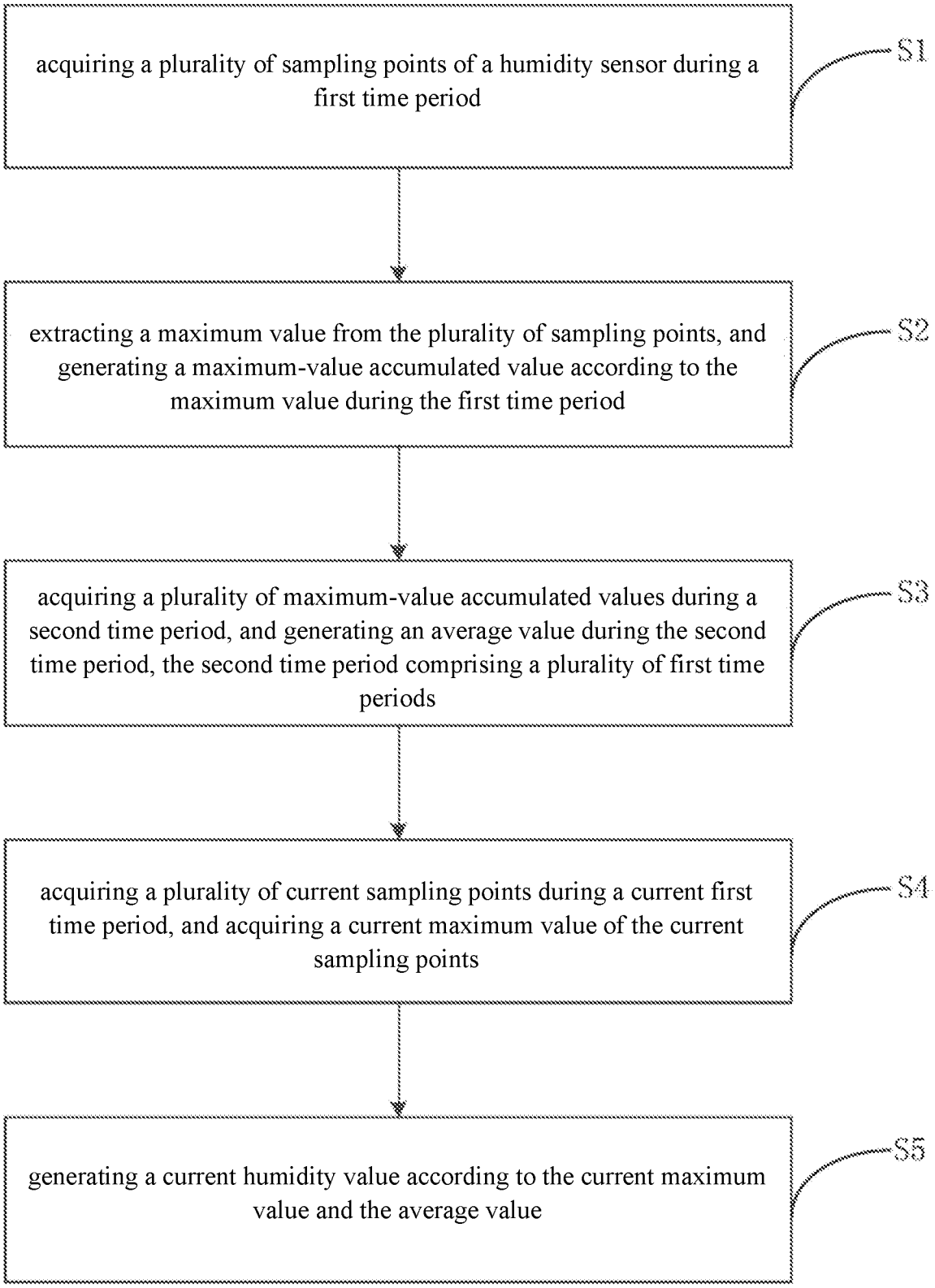
FIG. 1 is a flow chart of a method for calculating a humidity value of clothes in a clothes dryer according to an embodiment of the present disclosure.

REFERENCE NUMERALS first acquisition module 10,
first generation module 20,
second generation module 30,
second acquisition module 40,
third generation module 50,
clothes dryer 100, and
device 200 for calculating humidity value of clothes.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, illustrative, and used to generally understand the present disclosure. The embodiments shall not be construed to limit the present disclosure.

A method for calculating a humidity value of clothes in a clothes dryer, a device for calculating a humidity value of clothes in a clothes dryer, and a clothes dryer according to embodiments of the present disclosure will be described below in combination with the drawings.

FIG. 1 is a flow chart of a method for calculating a humidity value of clothes in a clothes dryer according to an embodiment of the present disclosure. As illustrated in FIG. 1, the method for calculating the humidity value of clothes in the clothes dryer includes the following actions.

At block S1, a plurality of sampling points of a humidity sensor during a first time period are acquired.

Five sampling points can be provided. That is, the first time period includes five humidity pulse periods, one sampling point is acquired during each humidity pulse period, and five sampling points are acquired during the first time period.

In addition, according to an embodiment of the present disclosure, the first time period is 0.5-1.5 seconds. Preferably, the first time period is 1 second. An action at block S1 can be understood as acquiring a set of sampling points of the humidity sensor every 1 second. For example, five sampling points are acquired in a time range of 0.5-1.5 seconds, which includes humidity 1, humidity 2, humidity 3, humidity 4, and humidity 5, in which the maximum value is the humidity 2. Then, in the next 1 second, i.e. in a time range of 1.5-2.5 seconds, other five sampling points of the humidity sensor are also acquired, which includes humidity 1', humidity 2', humidity 3', humidity 4', and humidity 5', in which the maximum value is the humidity 2'. And so on, five sampling points of the humidity sensor are respectively acquired every 1 second.

At block S2, a maximum value is extracted from the plurality of sampling points, and a maximum-value accumulated value is generated according to the maximum value during the first time period.

Using the above example again, the maximum value of the five sampling points in the time range of 0.5-1.5 seconds is the humidity 2, and the maximum value of the five sampling points in the time range of 1.5-2.5 seconds is the humidity 2'. An action at block S2 can be understood as extracting the maximum humidity 2 from the time range of 0.5-1.5 seconds, then extracting the maximum humidity 2' from the time range of 1.5-2.5 seconds, and accumulating two values of the humidity 2 and the humidity 2' to acquire a maximum-value accumulated value in 0.5-2.5 seconds.

And so on, the maximum value of the five sampling points is acquired and added to a previously obtained maximum-value accumulated value to acquire a new maximum-value accumulated value every second.

At block S3, a plurality of maximum-value accumulated values during a second time period are acquired, and an average value during the second time period is generated, in which the second time period includes a plurality of first time periods.

In the above actions, one maximum value is acquired during each first time period. The second time period includes a plurality of first time periods, and each first time period corresponds to one maximum-value accumulated value. Therefore, a plurality of maximum-value accumulated values are averaged to acquire the average value during the second time period.

Specifically, according to an embodiment of the present disclosure, the average value during the second time period is generated by the following formula:

(Σ(maxNewHumiValue1sec*the first time period))/(the second time period*60), in which the maxNewHumiValue1sec represents the maximum-value accumulated value.

Using the above example again, the maximum value in the time range of 0.5-1.5 seconds is denoted by X1, the maximum value in the time range of 1.5-2.5 seconds is denoted by X2, the maximum value in the time range of 2.5-3.5 seconds is denoted by X3, and so on, until the last maximum value Xn during the second time period is acquired. Then, X1, X2, X3 . . . Xn are added sequentially to obtain the maximum-value accumulated value, and the maximum-value accumulated value is divided by the second time period to obtain the average value Y during the second time period.

According to an embodiment of the present disclosure, the second time period is 2-4 minutes, preferably 3 minutes.

At block S4, a plurality of current sampling points during a current first time period are acquired, and a current maximum value of the current sampling points is acquired.

It could be understood that, the current first time period merely has the same value as that of the above-described first time period, while the current first time period is after the second time period. That is, the plurality of current sampling points during the current first time period are acquired after the average value is acquired during the second time period, the plurality of current sampling points can includes humidity 1", humidity 2", humidity 3", humidity 4" and humidity 5", in which the humidity 3" is the maximum value of the sampling points, i.e. the current maximum value during the current first time period is denoted by Z, such as a current sampling point acquired in the immediate 1 second after the 3 minutes.

At block S5, a current humidity value is generated according to the current maximum value and the average value.

According to an embodiment of the present disclosure, the current humidity value is generated by the following formula:

the current humidity value=the average value*0.995+the current maximum value*0.005.

That is to say, the formula for calculating the humidity value is:

the current humidity value=$Y$*0.995+$Z$*0.005.

Figure 2:
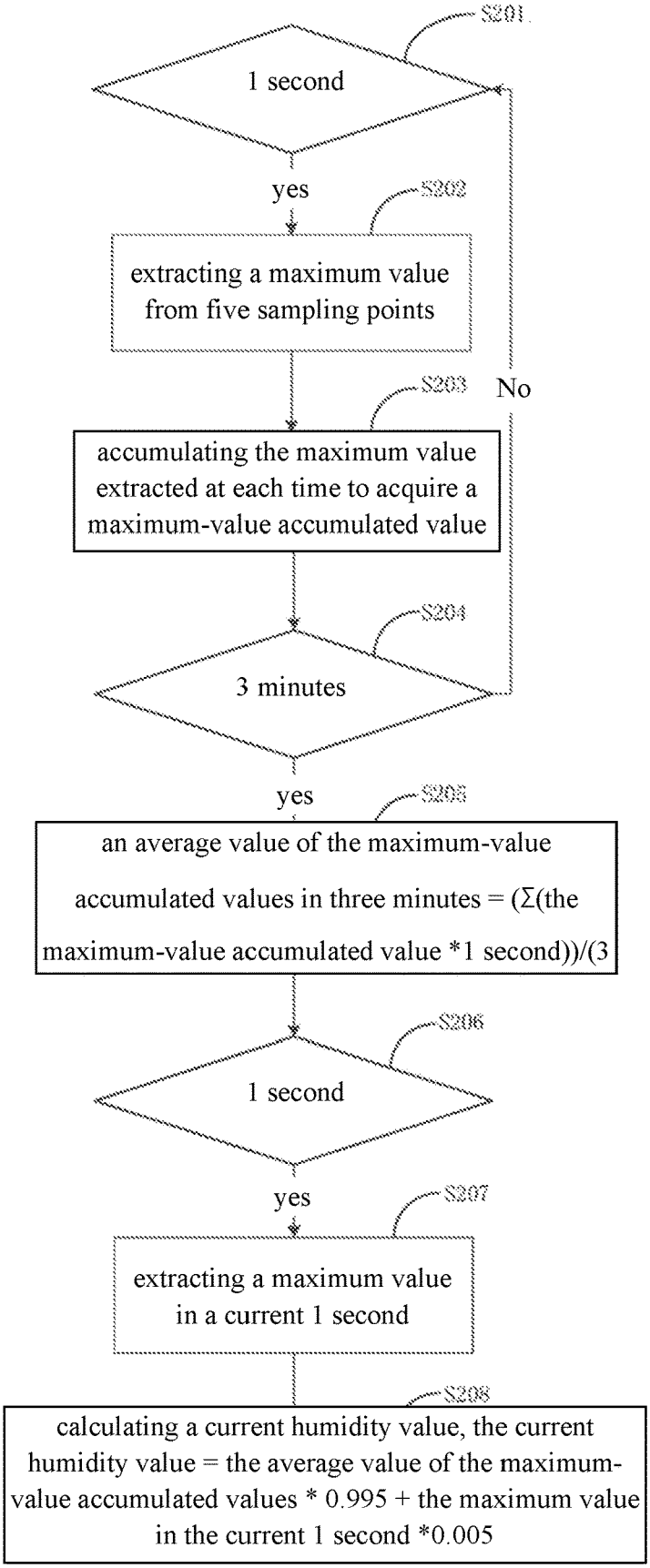
FIG. 2 is a flow chart of a method for calculating a humidity value of clothes in a clothes dryer according to a specific embodiment of the present disclosure.

Specifically, as illustrated in FIG. 2, the method for calculating the humidity value of the clothes in the clothes dryer includes the following actions.

At block S201, it is determined that whether a time interval reaches 1 second, if so, perform an action at block S202.

At block S202, the maximum value is extracted from the five sampling points in the time of 1 second.

At block S203, the maximum value extracted at each time is accumulated o acquire the maximum-value accumulated value.

At block S204, it is determined that whether time for performing an action at block S201 reaches 3 minutes, if so, perform an action at block S205, if not, return to the action at block S201.

At block S205, the average value of the maximum-value accumulated value in three minutes is acquired, and the formula is (Σ(the maximum-value accumulated value*1 second))/(3 minutes*60).

At block S206, it is determined that whether a time interval after acquiring the average value of the maximum-value accumulated value reaches 1 second, if so, perform an action at block S207.

At block S207, the maximum value is extracted in the current 1 second.

At block S208, the current humidity value is calculated, the current humidity value=the average value of the maximum-value accumulated value*0.995+the maximum value in the current 1 second*0.005.

In general, in the method for calculating the humidity value of clothes in the clothes dryer, first, the plurality of sampling points of the humidity sensor during the first time period are acquired. Next, the maximum value is extracted from the plurality of sampling points, and the maximum-value accumulated value is generated according to the maximum value during the first time period. Then the plurality of maximum-value accumulated values during the second time period are acquired, and the average value during the second time period is generated, in which the second time period includes a plurality of first time periods. Next, the plurality of current sampling points during the current first time period are acquired, and the current maximum value of the current sampling points is acquired. Finally the current humidity value is generated according to the current maximum value and the average value. Therefore, the humidity situation of the clothes in the clothes dryer can be comprehensively considered with the method for calculating the humidity value of clothes in the clothes dryer, which prevents from excessive drying or incomplete drying of the clothes, and improves the user experience.

Figure 3:
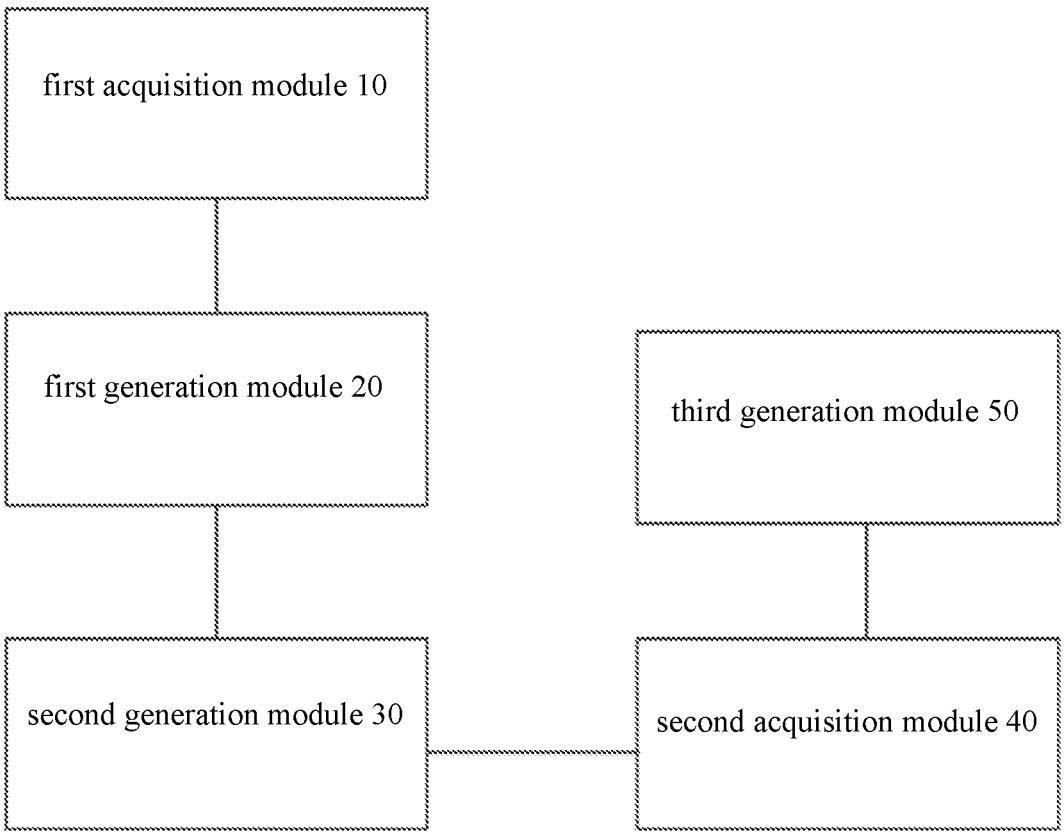
FIG. 3 is a block diagram of a device for calculating a humidity value of clothes in a clothes dryer according to an embodiment of the present disclosure.

In addition, as illustrated in FIG. 3, embodiments of the present disclosure also provide a device for calculating the humidity value of the clothes in the clothes dryer, which includes a first acquisition module 10, a first generation module 20, a second generation module 30, a second acquisition module 40 and a third generation module 50.

The plurality of sampling points of the humidity sensor during the first time period are acquired by means of the first acquisition module 10. Next, the first generation module 20 extracts the maximum value from the plurality of sampling points, and generates the maximum-value accumulated value according to the maximum value during the first time period. Then the second generation module 30 acquires the plurality of maximum-value accumulated values during the second time period, and generates the average value during the second time period, in which the second time period includes a plurality of first time periods. Next, the second acquisition module 40 acquires the plurality of current sampling points during the current first time period, and acquires the current maximum value of the current sampling points. Finally, the third generation module 50 generates the current humidity value according to the current maximum value and the average value. Therefore, the humidity situation of the clothes in the clothes dryer can be comprehensively considered, which prevents from excessive drying or incomplete drying of the clothes, and improves the user experience.

According to an embodiment of the present disclosure, the average value during the second time period is generated by the following formula:

$$(\Sigma(\text{maxNewHumiValue1sec}*\text{the first time period}))/(\text{the second time period}*60),$$

in which maxNewHumiValue1sec represents the maximum-value accumulated value.

According to an embodiment of the present disclosure, the first time period is 0.5-1.5 seconds, and the second time period is 2-4 minutes, preferably 3 minutes.

According to an embodiment of the present disclosure, the current humidity value is generated by the following formula:

$$\text{the current humidity value}=\text{the average value}*0.995+\text{the current maximum value}*0.005.$$

Specifically, the first acquiring module 10 acquires the plurality of sampling points during the first time period of 0.5-1.5 seconds, the first acquiring module 10 acquires the plurality of sampling points during the next first time period of 1.5-2.5 seconds, and so on, the first acquiring module 10 acquires a plurality of sampling points during Nth first time period (i.e. 1 second interval), until the end of the initial second time period. The first generation module 20 extracts the maximum value from the plurality of sampling points during the first time period of 0.5-1.5 seconds. Then the first generation module 20 extracts the maximum value from the plurality of sampling points during the next first time period of 1.5-2.5 seconds, and the maximum value is added to the previously extracted maximum value to acquire the maximum-value accumulated value.

Then, the second generation module 30 acquires the maximum-value accumulated value during one second time period (which may be 3 minutes), and acquires the average value of the maximum-value accumulated value during the second time period. Next, the second acquisition module 40 acquires the plurality of current sampling points during the current first time period after the second time period, that is, the second acquisition module 40 acquires the plurality of sampling points after the second generation module 30 acquires the average value. The third generation module 50 extracts the maximum value from the plurality of current sampling points, and finally calculates the humidity value of the current clothes with the humidity calculating formula, so as to avoid inaccurate humidity calculation due to uneven humidity, insufficient contact, contact probability of the clothes or the like, which otherwise results in a situation that the clothes has an unsatisfactory drying effect.

In general, with the device for calculating the humidity value of clothes in the clothes dryer, the plurality of sampling points of the humidity sensor during the first time period are acquired by means of the first acquisition module. Next, the first generation module extracts the maximum value from the plurality of sampling points, and generates the maximum-value accumulated value according to the maximum value during the first time period. Then the second generation module acquires the plurality of maximum-value accumulated values during the second time period, and generates the average value during the second time period, in which the second time period includes a plurality of first time periods. Next, the second acquisition module acquires the plurality of current sampling points during the current first time period, and acquires the current maximum value of the current sampling points. Finally, the third generation module generates the current humidity value according to the current maximum value and the average value. Therefore, the humidity situation of the clothes in the clothes dryer can be comprehensively considered, which prevents from excessive drying or incomplete drying of the clothes, and improves the user experience.

Figure 4:
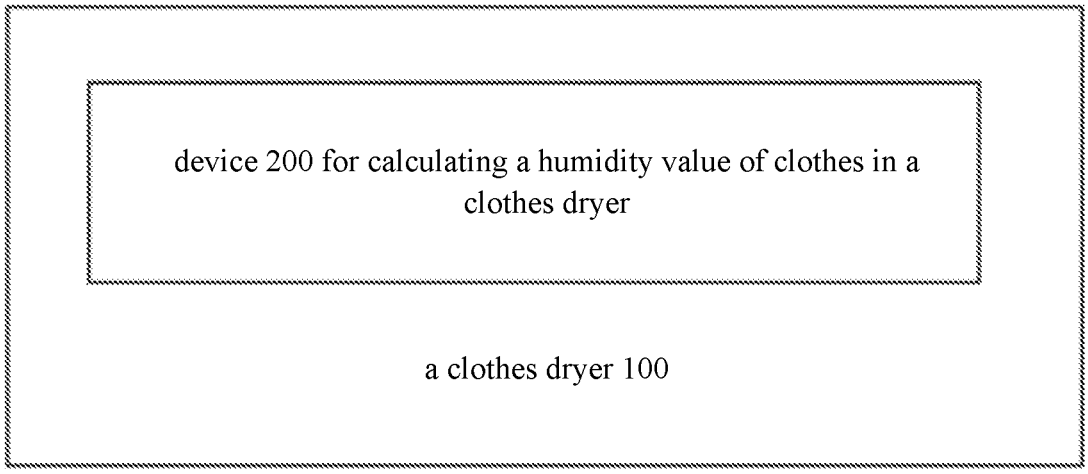
FIG. 4 is a block diagram of a clothes dryer according to an embodiment of the present disclosure.

In addition, as illustrated in FIG. 4, embodiments of the present disclosure also provide a clothes dryer 100, the clothes dryer includes the device 200 for calculating the humidity value of the clothes in the clothes dryer described above.

In general, in the clothes dryer according to embodiments of the present disclosure, by providing the device for calculating the humidity of the clothes, the humidity situation of the clothes in the clothes dryer can be comprehensively considered, which prevents from excessive drying or incomplete drying of the clothes, and improves the user experience.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not require that the present disclosure be constructed or operated in a particular orientation and should not be construed to limit the present disclosure.

In addition, terms such as "first" and "second" are used herein for purposes of description and are not intended to indicate or imply relative importance or significance. Thus, the feature defined with "first" and "second" may indicate or imply that at least one this feature is included. In the description of the present disclosure, a term "a plurality of" means at least two, such as two, three, etc., unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature. While a first feature "below," "under," or "on bottom of" a second feature may include an embodiment in which the first feature is right or obliquely "below,"

"under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, without conflicting, various embodiments or examples or features of various embodiments or examples described in the present specification may be combined by those skilled in the art.

Although explanatory embodiments have been shown and described, it would be appreciated by those skilled in the art that the above embodiments cannot be construed to limit the present disclosure, and changes, modifications, alternatives, and variants can be made in the embodiments without departing from scope of the present disclosure.

What is claimed is:

1. A method for determining a humidity value of clothes within a clothes dryer performed at a computing device associated with the clothes dryer, comprising:

acquiring a plurality of sampling points measured by a humidity sensor during a first time period;

extracting one or more maximum values from the plurality of sampling points;

generating a maximum-value accumulated value by summing the one or more maximum values during the first time period;

acquiring, using the humidity sensor in the clothes dryer, a plurality of maximum-value accumulated values measured during a second time period by repeating said acquiring, extracting and generating steps;

generating an average value according to the plurality of maximum-value accumulated values during the second time period, the second time period comprising a plurality of first time periods;

acquiring a plurality of current sampling points during a current first time period;

determining a current maximum value of the current sampling points;

generating a current humidity value according to a predefined relationship between the current maximum value and the average value, and controlling an operation of the clothes dryer based on the current humidity value to prevent the clothes dryer from excessively drying the clothes or incompletely drying the clothes.

2. The method according to claim 1, wherein the average value during the second time period is generated by the following formula:

$$(\Sigma(\text{maxNewHumiValue1sec}*\text{the first time period}))/(\text{the second time period}*60),$$

wherein the maxNewHumiValue1sec represents the maximum-value accumulated value during the first time period.

3. The method according to claim 1, wherein the first time period is 0.5-1.5 seconds.

4. The method according to claim 1, wherein the second time period is 2-4 minutes.

5. The method according to claim 1, wherein the current humidity value is generated by the following formula:

$$\text{the current humidity value}=\text{the average value}*0.995+\text{the current maximum value}*0.005.$$

6. A device for determining a humidity value of clothes in a clothes dryer, comprising a processor, memory coupled to the processor, a plurality of program instructions stored in the memory that, when executed by the processor, cause the device to perform a plurality of operations including:

acquiring a plurality of sampling points measured by a humidity sensor during a first time period;

extracting one or more maximum values from the plurality of sampling points;

generating a maximum-value accumulated value by summing the one or more maximum values during the first time period;

acquiring a plurality of maximum-value accumulated values during a second time period by repeating said acquiring, extracting and generating steps;

generating an average value according to the plurality of maximum-value accumulated values during the second time period, the second time period comprising a plurality of first time periods;

acquiring a plurality of current sampling points during a current first time period;

determining a current maximum value of the current sampling points;

generating a current humidity value according to a predefined relationship between the current maximum value and the average value; and controlling an operation of the clothes dryer based on the current humidity value to prevent the clothes dryer from excessively drying the clothes or incompletely drying the clothes, wherein the device is in the clothes dryer.

7. The device according to claim 6, wherein the average value during the second time period is generated by the following formula:

$$(\Sigma(\text{maxNewHumiValue1sec}*\text{the first time period}))/(\text{the second time period}*60),$$

wherein the maxNewHumiValue1sec represents the maximum-value accumulated value during the first time period.

8. The device according to claim 6, wherein the first time period is 0.5-1.5 seconds, and the second time period is 2-4 minutes.

9. The device according to claim 6, wherein the current humidity value is generated by the following formula:

$$\text{the current humidity value}=\text{the average value}*0.995+\text{the current maximum value}*0.005.$$

10. A clothes dryer, comprising:

a humidity sensor; and a device for calculating a humidity value of clothes in the clothes dryer, the device comprising a processor, memory coupled to the processor, a plurality of program instructions stored in the memory that, when executed by the processor, cause the device to perform a plurality of operations including:

acquiring a plurality of sampling points of the humidity sensor during a first time period;

extracting one or more maximum values from the plurality of sampling points;

generating a maximum-value accumulated value by summing the one or more maximum values during the first time period;

acquiring a plurality of maximum-value accumulated values during a second time period by repeating said acquiring, extracting and generating steps;

generating an average value according to the plurality of maximum-value accumulated values during the second time period, the second time period comprising a plurality of first time periods;

acquiring a plurality of current sampling points during a current first time period;

determining a current maximum value of the current sampling points; and generating a current humidity value according to a predefined relationship between the current maximum value and the average value.

11. The clothes dryer according to claim 10, wherein the average value during the second time period is generated by the following formula:

$$(\Sigma/(\text{maxNewHumiValue1sec}*\text{the first time period}))/(\text{the second time period}*60),$$

wherein the maxNewHumiValue1sec represents the maximum-value accumulated value during the first time period.

12. The clothes dryer according to claim 10, wherein the first time period is 0.5-1.5 seconds, and the second time period is 2-4 minutes.

13. The clothes dryer according to claim 10, wherein the current humidity value is generated by the following formula:

$$\text{the current humidity value}=\text{the average value}*0.995+\text{the current maximum value}*0.005.$$

* * * * *